United States Patent [19]

Tritt

[11] 4,372,241

[45] Feb. 8, 1983

[54] RUDDER ASSEMBLY

[76] Inventor: William R. Tritt, 1145 Grove St., St. Petersburg, Fla. 33701

[21] Appl. No.: 223,728

[22] Filed: Jan. 9, 1981

[51] Int. Cl.[3] ..... B63H 25/06

[52] U.S. Cl. ..... 114/162; 114/165

[58] Field of Search ..... 114/162, 165, 169, 172

[56] References Cited

U.S. PATENT DOCUMENTS

| | | | |
|---|---|---|---|
| 3,199,458 | 8/1965 | Snider | 114/165 |
| 4,008,677 | 2/1977 | Wordell | 114/162 |

FOREIGN PATENT DOCUMENTS

| | | | |
|---|---|---|---|
| 2372078 | 11/1977 | France | 114/162 |
| 7610418 | 3/1977 | Netherlands | 114/162 |

*Primary Examiner*—Trygve M. Blix
*Assistant Examiner*—Thomas J. Brahan
*Attorney, Agent, or Firm*—William M. Hobby, III

[57] ABSTRACT

A rudder assembly for sail boats and the like comprising a rudder support frame pivotally attached to the stern portion of the boat, a substantially horizontal tiller fixedly attached to the upper portion of the rudder support frame, a rudder blade pivotally coupled to the rudder support frame, a rudder blade control mechanism including kickup control arm pivotally coupled to the upper portion of the rudder blade and an interconnecting kickup control member pivotally coupled between the kickup control arm and the substantially horizontal tiller to selectively move the rudder blade between a first or lower position, intermediate or trail position and second or upper position by the pushing or pulling of the kickup control arm, the rudder blade control mechanism further includes a lock member fixedly attached to the kickup control arm disposed to selectively engage the substantially horizontal tiller to lock the rudder blade in the lower or upper position.

7 Claims, 5 Drawing Figures

RUDDER ASSEMBLY

BACKGROUND OF THE INVENTION

1. Field of the Invention

A rudder assembly for sail boats and the like comprising a rudder support frame in combination with a rudder blade pivotally attached thereto and a rudder blade control mechanism configured to selectively move the rudder blade between a first or lower position and a second or upper position during operation.

2. Description of the Prior Art

Sailboats and the like often employ retractable rudders which permit the vessel to move into shallow waters without causing harm to the rudder. Typically the rudder blade is movable between, a fully extended position and a fully retracted position. At these extreme positions, the rudder blade is held against further movement by means of a locking mechanism or similar device. Thus, numerous kickup rudders movable between a lower and raised position have been developed. Such rudders may generally be locked or secured in either the lower or raised position.

In a number of devices, the tiller itself is used to control the depth of the rudder blade. Any benefit by combining the normal operation of the tiller with the operation or raising and lowering the rudder blade under normal conditions is dubuious since it can be hazardous under adverse conditions. Under such conditions each of the operations should be performed separately and by means of separate devices to assure independence of operation and without comprising the performance characteristics of each device.

Examples of the prior art are disclosed in the following U.S. Pat. Nos.: 3,038,433; 3,352,272; 3,575,124; 3,728,983; 3,921,561; 4,008,677; 4,088,088; 4,218,986.

SUMMARY OF THE INVENTION

The present invention relates to a rudder assembly for sailboats or the like, comprising a rudder support frame pivotally coupled to the stern portion of the boat, a tiller arm fixedly attached to the upper portion of the rudder support frame and a rudder blade pivotally attached to the rudder support frame.

A rudder blade control mechanism comprises kickup control arm pivotally connected to the upper portion of the rudder blade, a lock member fixedly attached to the forward end thereof and an interconnecting kickup control member pivotally attached at opposite ends thereof to the kickup control arm and tiller arm.

The interconnecting kickup control member is pivotally connected to the kickup control arm by means of first or upper pivot arm pin and to the tiller arm by a second or lower pivot arm pin. The lock member may comprise a substantially U-shaped spring clip element.

In operation, the rudder blade would normally be disposed in the substantially vertical position. In this configuration the lock member would operatively engage the tiller arm thus locking the tiller arm and kickup control arm to hold the rudder blade in the substantially vertical position. When approaching shallow waters, the operator may release the lock member from the tiller arm by raising upward on the kickup control arm. Once the lock member is disengaged the operator pulls forward on the kickup control arm cuasing the interconnecting kickup control member to rotate from its rearward position which in turn pulls the upper portion of rudder blade forward until the rudder blade reaches the second or upper position. Again the lock member is engaged in its forward position with the tiller arm locking the rudder blade in the upper or second position. To lower the rudder blade, the operation is reversed.

In addition to the normal operations, the rudder assembly is specifically configured to be used in shallow waters permitting the rudder blade to move from the first or lower position to the intermediate position in shallow waters. Specifically as the boat moves into shallow water the rudder blade may strike the bottom forcing the rudder blade to be partially kicked up. This operation is enhanced by the location of the upper or first pivot arm member rearward relative to the lower or second pivot arm member when in the first or lower position.

The invention accordingly comprises the features of construction, combination of elements, and arrangement of parts that will be exemplified in the construction hereinafter set forth, and the scope of the invention will be indicated in the claims.

DESCRIPTION OF THE DRAWINGS

For a fuller understanding of the nature and objects of the invention, reference should be had to the following detailed description taken in connection with the accompanying drawings in which.

Similar referenced characters refer to similar parts throughout the several views of the drawings.

DETAILED DESCRIPTION OF THE PREFERRED EMBODIMENT

Figure 1:
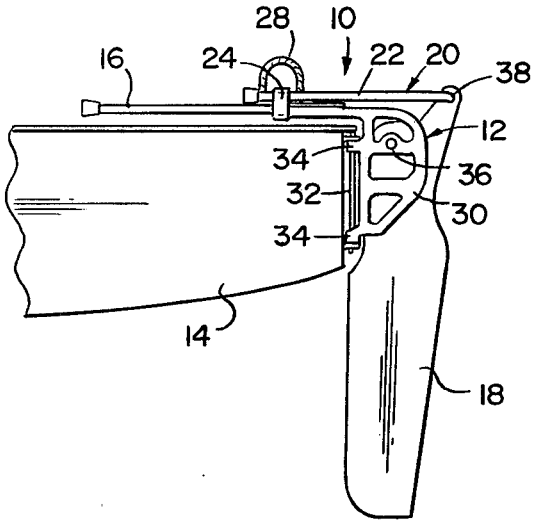
FIG. 1 is a side view of the rudder assembly in the first or lower position.
Figure 2:
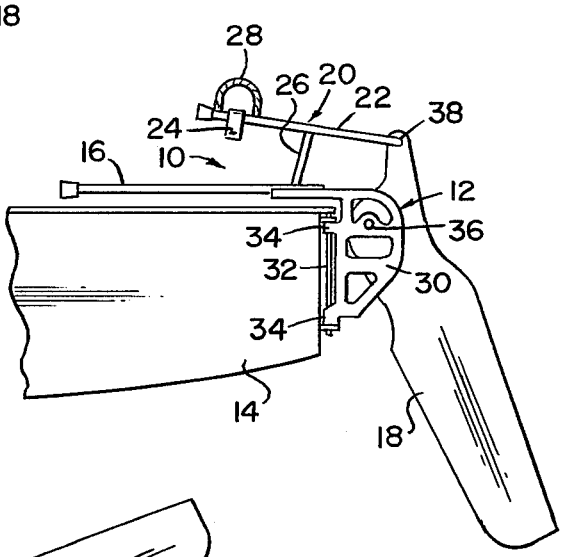
FIG. 2 is a side view of the rudder assembly in the intermediate or trail position.
Figure 3:
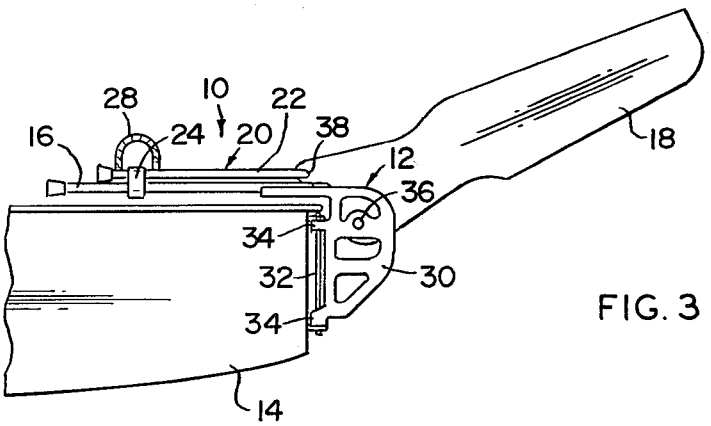
FIG. 3 is a side view of the rudder assembly in the second or upper position.

As best shown in FIGS. 1 through 3, the present invention relates to a rudder assembly generally indicated as 10 for sailboats or the like. The rudder assembly 10 comprises a rudder support frame generally indicated as 12 pivotally coupled to the stern portion of the boat 14, a tiller arm 16 fixedly attached to the upper portion of the rudder support frame 12 and a rudder blade 18 pivotally attached to the rudder support frame 12.

As best shown in FIG. 2, a rudder blade control mechanism generally indicated as 20, comprises kickup control arm 22 pivotally connected to the upper portion of the rudder blade 18, a lock member 24 fixedly attached to the forward or opposite end thereof and an interconnecting kickup control member 26 pivotally attached at opposite ends thereof to the kickup control arm 22 and tiller arm 16. In addition the rudder blade control mechanism 20 may include a handle grip 28 to facilitate actuation of the rudder blade control mechanism 20 as more fully described hereinafter.

As shown in FIGS. 1 through 3, the rudder support frame 12 comprises a pair of side frame members 30 pivotally attached to the stern portion of the boat 14 by means of a substantially vertical rudder pin 32 extending between mounting members 34 disposed at opposite ends thereof and fixedly attached to the stern portion of the boat 14. The rudder blade 18 is pivotally coupled between the pair of side frame members 30 by pivot member 36. The kickup control arm 22 is pivotally coupled to the upper portion of the rudder blade 18 by means of rudder clevice pin or member 38.

Figure 4:
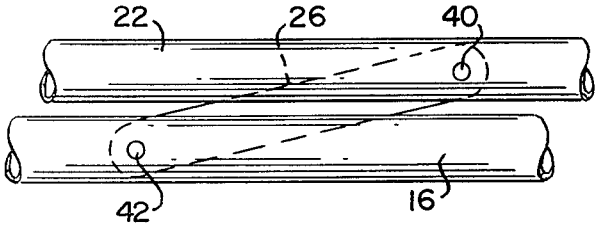
FIG. 4 is a partial detailed side view of the rudder blade control mechanism.
Figure 5:
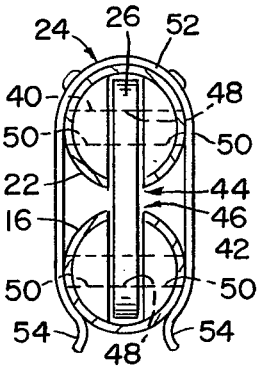
FIG. 5 is a detailed end view of the lock member.

As best shown in FIG. 4 the interconnecting kickup control member 26 is pivotally connected to the kickup control arm 22 by means of first or upper pivot arm pin 40 and to the tiller arm 16 by a second or lower pivot arm pin 42. The kickup control arm 22 includes an elongated slot 44 formed on the lower portion thereof while tiller arm 16 includes elongated slot 46 formed on the upper portion thereof to receive the interconnecting kickup control member 26 therethrough. As best shown in FIG. 5 upper and lower pivot arm members 40 and 42 extend through apertures 48 formed on opposite ends of the interconnecting kickup control member 26 and through apertures 50 formed on opposite sides of both the tiller arm 16 and kickup control arm 22. In addition, bearings may be included to enhance the operation of the rudder blade kickup control mechanism 20. As best shown in FIG. 5 the lock member 24 may comprise a substantially U-shaped spring clip element 52 having reduced portion or clamping member 54 formed on each end thereof.

In operation, the rudder blade 18 would normally be disposed in the substantially vertical position as best shown in FIG. 1. In this configuration the lock member 24 would operatively engage the tiller arm 16 as best shown in FIGS. 1 and 5, thus locking the tiller arm 16 and kickup control arm 22 to hold the rudder blade 18 in the substantially vertical position. When approaching shallow waters, the operator may release the lock member 24 from the tiller arm 16 by raising upward on the kickup control arm 22 either directly or through the use of the handle grip 28. Once the lock member 24 is disengaged the operator pulls forward on the kickup control arm 22 causing the interconnecting kickup control member 26 to rotate from its rearward position, as best shown in FIG. 4, which in turn pulls the upper portion of the rudder blade 18 forward through rudder clevice, pin or member 38 rotating the entire rudder blade 18 through the intermediate position as best shown in FIG. 2 until the rudder blade 18 reaches, the second or upper position as best shown in FIG. 3. Again the lock member 24 is engaged in its forward position with the tiller arm 16 locking the rudder blade 18 in the upper or second position. To lower the rudder blade 18 the operation is reversed.

In addition to the normal operations, the rudder assembly 10 is specifically configured to be used in shallow waters permitting the rudder blade 18 to move from the first or lower position to the intermediate position in shallow waters. Specifically as the boat 14 moves into shallow water, the rudder blade 18 may strike the bottom forcing the rudder blade 18 to be partially kicked up as shown in FIG. 2. This operation is enhanced by the location of the upper or first pivot arm member 40 rearward relative to the lower or second pivot arm member 42 when in the first or lower position as best shown in FIG. 4. As a result of the relative positioning of the upper and lower pivot arm members 40 and 42 respectively, the rudder blade 18 easily disengages or unlocks lock member 24 from the tiller 16 when the lower portion of the rudder blade 18 engages the shore or bottom.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described,

What is claimed is:

1. A rudder assembly for sailboats, and the like, comprising a rudder support frame pivotally attached to the stern portion of the boat, a tiller fixedly attached to the rudder support frame, said tiller being substantially horizontally disposed, a rudder blade pivotally coupled to the rudder support frame, a rudder blade control mechanism including kickup control arm pivotally coupled to said rudder blade and an interconnecting control member pivotally coupled between said kickup control arm and said tiller to selectively move said rudder blade between a first lower position, and second upper position by the pushing or pulling of said kickup control arm, said kickup control arm being substantially parallel to said substantially horizontal tiller when in said first or second position.

2. The rudder assembly of claim 1 wherein said interconnecting kickup control member is coupled to said kickup control arm by a first pivot arm pin and to said tiller arm by a second pivot arm pin, said first pivot arm pin being disposed rearward of said second pivot arm pin relative to said stern portion when said rudder blade is in said first position.

3. The rudder assembly of claim 2 wherein said first pivot arm pin is disposed forward of said second pivot arm pin relative to said stern portion of the boat when said rudder blade is in said second position.

4. The rudder assembly of claim 2 wherein said kickup control arm includes an elongated slot formed on the lower portion thereof and said tiller includes an elongated slot formed on the upper portion thereof to operatively receive said interconnecting kickup control member therethrough.

5. The rudder assembly of claim 1 wherein said rudder blade control mechanism further includes a lock member fixedly attached to said kickup control arm disposed to selectively engage said tiller to lock said rudder blade in said first or second position.

6. The rudder assembly of claim 1 wherein said rudder blade is disposed substantially vertical when in said lower position and substantially horizontal when in said upper position.

7. The rudder assembly of claim 6 further including an intermediate or trail position.

* * * * *